US010934706B2

(12) United States Patent
Stein

(10) Patent No.: US 10,934,706 B2
(45) Date of Patent: Mar. 2, 2021

(54) SYSTEM AND METHOD FOR ATTACHING GLASS PANELS TO A SUBSTRUCTURE

(71) Applicant: Alan Stein, Easton, MD (US)

(72) Inventor: Alan Stein, Easton, MD (US)

( * ) Notice: Subject to any disclaimer, the term of this patent is extended or adjusted under 35 U.S.C. 154(b) by 0 days.

(21) Appl. No.: 15/938,102

(22) Filed: Mar. 28, 2018

(65) Prior Publication Data

US 2018/0283003 A1 Oct. 4, 2018

Related U.S. Application Data

(60) Provisional application No. 62/479,099, filed on Mar. 30, 2017.

(51) Int. Cl.

| | |
|---|---|
| ***E04B 2/90*** | (2006.01) |
| ***E04B 2/96*** | (2006.01) |
| ***E04D 3/08*** | (2006.01) |

(52) U.S. Cl.

CPC ..... *E04B 2/90* (2013.01); *E04B 2/967* (2013.01); *E04D 3/08* (2013.01); *E04D 2003/0856* (2013.01); *E04D 2003/0875* (2013.01)

(58) Field of Classification Search

CPC ... E04B 2/90; E04B 2/967; E04D 3/08; E04D 2003/0875; E04D 2003/0856; E04D 3/666; E04D 3/38; E04D 3/06; E04D 2003/0862; E04D 13/174; E04D 13/0305; E04D 13/0315; E04D 13/032

USPC ..... 52/395, 57, 200

See application file for complete search history.

(56) References Cited

U.S. PATENT DOCUMENTS 165,113 A * 6/1875 Morsell ..... E04D 3/08 52/464
255,436 A * 3/1882 Leadley ..... E04D 13/03 52/200
905,064 A * 11/1908 Fingal ..... E04D 3/08 52/464

(Continued)

FOREIGN PATENT DOCUMENTS

CH 497636 A * 10/1970 ..... E04B 2/967
CH 597450 A5 * 4/1978 ..... E04B 2/967

(Continued)

OTHER PUBLICATIONS

DE-202010001303-U1 English Translation (Year: 2010).*

*Primary Examiner* — Ryan D Kwiecinski
*Assistant Examiner* — Matthew J Gitlin
(74) *Attorney, Agent, or Firm* — Rankin, Hill & Clark LLP

(57) ABSTRACT

A system and method is provided for attaching glass panels to a substructure. Embodiments include a blocking extending along a length of a structural element and attached to a first portion of a surface of the structural element. Flashing covers the blocking, and has a flange extending outward from a lower edge of the blocking to contact a second portion of the surface of the structural element. An elastic flange gasket covers an outer edge of the flange and contacts an inner main surface of a glass panel. A glazing cap extends along the blocking, having an elastic cap gasket for contacting the outer main surface of the glass panel. The glazing cap extends over and attaches to the blocking for retaining the glass panel between the flange gasket and the cap gasket, and for sealing the glass panel, the flange gasket, and the cap gasket.

16 Claims, 9 Drawing Sheets

(56) References Cited

U.S. PATENT DOCUMENTS

| | | | | | |
|---|---|---|---|---|---|
| 981,813 | A * | 1/1911 | Storch | E04D 3/08 | 52/395 |
| 1,227,861 | A * | 5/1917 | Waugh | E04D 3/08 | 52/395 |
| 1,638,668 | A * | 8/1927 | Volk | E04B 7/063 | 52/200 |
| 1,921,303 | A * | 8/1933 | Raschka | E04B 7/063 | 52/200 |
| 3,320,707 | A * | 5/1967 | Berg | E04D 13/1415 | 52/395 |
| 3,577,691 | A * | 5/1971 | Persson | E04D 13/0358 | 52/72 |
| 4,418,506 | A * | 12/1983 | Weber | E04B 2/967 | 52/204.593 |
| 4,711,061 | A * | 12/1987 | Wilkinson | E04D 3/351 | 52/22 |
| 4,942,711 | A * | 7/1990 | Bergquist | E04D 3/08 | 52/204.591 |
| 4,996,809 | A * | 3/1991 | Beard | E04B 1/0046 | 52/200 |
| 6,151,845 | A * | 11/2000 | Lancaster | E04B 7/063 | 52/198 |
| 9,328,513 | B2 * | 5/2016 | Maguire | E04D 13/032 | |
| 2015/0284951 | A1 * | 10/2015 | Frederick | E04B 2/90 | 52/235 |
| 2016/0053487 | A1 * | 2/2016 | Frederick | E04B 2/96 | 52/235 |
| 2016/0069073 | A1 * | 3/2016 | Grise | E04B 1/6801 | 52/235 |
| 2018/0023295 | A1 * | 1/2018 | Ander | E04B 2/967 | 52/204.62 |

FOREIGN PATENT DOCUMENTS

| | | | | | |
|---|---|---|---|---|---|
| DE | 455631 | C * | 2/1928 | E04D 3/14 | |
| DE | 4018003 | A1 * | 1/1992 | E04B 2/967 | |
| DE | 4224923 | A1 * | 2/1994 | E04B 1/943 | |
| DE | 29618365 | U1 * | 4/1997 | E04B 1/78 | |
| DE | 29711229 | U1 * | 9/1997 | E04B 2/967 | |
| DE | 29722883 | U1 * | 2/1998 | E04B 2/967 | |
| DE | 20319566 | U1 * | 7/2004 | E04B 2/967 | |
| DE | 202010001303 | U1 * | 6/2011 | E04B 2/967 | |
| DE | 202012001635 | U1 * | 4/2012 | E04B 2/967 | |
| EP | 0675243 | A1 * | 10/1995 | E04C 3/07 | |
| EP | 1127990 | A2 * | 8/2001 | E04B 2/967 | |
| EP | 1544369 | B1 * | 11/2009 | E04B 2/967 | |
| FR | 1300846 | A * | 8/1962 | E04B 2/967 | |
| FR | 2380405 | A1 * | 9/1978 | E04D 3/08 | |
| GB | 183988 | A * | 8/1922 | E04D 3/08 | |
| GB | 347015 | A * | 4/1931 | E04D 3/06 | |
| GB | 496101 | A * | 11/1938 | E04D 3/14 | |
| WO | WO-2004097140 | A1 * | 11/2004 | E04B 2/967 | |
| WO | WO-2010063297 | A1 * | 6/2010 | E04B 2/967 | |
| WO | WO-2012041300 | A1 * | 4/2012 | E04B 2/967 | |

* cited by examiner

SYSTEM AND METHOD FOR ATTACHING GLASS PANELS TO A SUBSTRUCTURE

RELATED APPLICATIONS

The present application claims priority to U.S. Provisional Application No. 62/479,099, entitled "System and Method for Attaching Glass Panels to a Substructure," filed Mar. 30, 2017, which is incorporated herein by reference in its entirety.

FIELD

Embodiments relate generally to the construction of buildings and specific features of buildings such as skylights, window walls, and other glass and frame elements such as sunrooms and greenhouses. More particularly, embodiments relate to a system and technique for the attachment of glass panels to a substructure of steel or other material.

BACKGROUND

Currently available systems and methods for attaching glass to a substructure, for use in skylights, window walls, and other glass and frame elements such as sunrooms and greenhouses, rely on an intermediate system or assembly (typically of aluminum extrusions) to support the glass panels. The intermediate assembly is itself supported by the substructure, which is typically steel. This conventional methodology is disadvantageously heavy, expensive, and complex. Further, its aluminum framing is aesthetically undesirable insofar as it does not allow a slim line architectural appearance.

There is a need for a relatively simple, inexpensive system and methodology for attaching glass panels to a substructure that allows greater design flexibility.

SUMMARY

Disclosed is a system and method for mounting glass panels directly onto a structural element, eliminating the need for an aluminum substructure. The disclosed systems advantageously reduce weight, cost, and complexity, and improve aesthetics by enabling a slim line architectural appearance.

One or more embodiments include a system comprising a blocking extending along a length of a structural element, the blocking attached to a first portion of a surface of the structural element. A flashing covers the blocking, the flashing having a first flange extending outward from a lower edge of the blocking proximal the first portion of the surface of the structural element, to contact a second portion of the surface of the structural element not in contact with the blocking. A first elastic flange gasket covers an outer edge of the first flange. The first flange gasket is for contacting the inner main surface of a first glass panel having inner and outer main surfaces. A glazing cap extends along a length of the blocking, and has a first elastic cap gasket for contacting the outer main surface of the first glass panel, the glazing cap extending over and attaching to the blocking for retaining the first glass panel between the first flange gasket and the first cap gasket.

In further embodiments, the flashing comprises a second flange on an opposing side of the blocking from the first flange, the second flange extending outward from a lower edge of the opposing side of the blocking proximal the first portion of the surface of the structural element, to contact a third portion of the surface of the structural element not in contact with the blocking. The system further includes a second elastic flange gasket for covering an outer edge of the second flange; and a second glass panel having inner and outer main surfaces, wherein the second flange gasket is for contacting the inner main surface of the second glass panel. The glazing cap has a second elastic cap gasket for contacting the outer main surface of the second glass panel, for retaining the second glass panel between the second flange gasket and the second cap gasket.

In other embodiments, the flashing is omitted and gaskets sit directly on the surface of the structural element, rather than on flanges of the flashing.

Further embodiments comprise a system having a blocking extending along a length of a structural element and attached to a surface of a structural element, the blocking having an upper surface, a lower surface for contacting the structural element surface, and a pair of opposing first and second side surfaces between the upper and lower surfaces. Each of the side surfaces has a step portion extending outward proximal to where the side surface meets the blocking lower surface. A flashing covers the upper surface of the blocking. The system further comprises a elastic first lower gasket extending along a length of the step portion of the first side surface of the blocking; a first glass panel having inner and outer main surfaces, wherein the first lower gasket is for contacting the inner main surface of the first glass panel; and a first glazing cap extending along a length of the blocking having a first elastic cap gasket for contacting the outer main surface of the first glass panel and a second elastic cap gasket for contacting the flashing, the first glazing cap extending over and attaching to the blocking for retaining the first glass panel between the first lower gasket and the first cap gasket. The system also has a second elastic lower gasket extending along the length of the step portion of the second side surface of the blocking; a second glass panel having inner and outer main surfaces, wherein the second lower gasket is for contacting the inner main surface of the second glass panel; and a second glazing cap extending along the length of the blocking, having a third elastic cap gasket for contacting the outer main surface of the second glass panel and a fourth elastic cap gasket for contacting the flashing, the second glazing cap extending over and attaching to the blocking for retaining the second glass panel between the second lower gasket and the third cap gasket.

Objects and advantages of embodiments of the disclosed subject matter will become apparent from the following description when considered in conjunction with the accompanying drawings.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DETAILED DESCRIPTION

It should be understood that the principles described herein are not limited in application to the details of construction or the arrangement of components set forth in the following description or illustrated in the following drawings. The principles can be embodied in other embodiments and can be practiced or carried out in various ways. Also, it is to be understood that the phraseology and terminology used herein is for the purpose of description and should not be regarded as limiting.

Disclosed herein are methods and systems for the attachment of glass panels to a substructure of steel or other material. According to the present disclosure, glass panels are mounted directly onto the structure. Among the advantages of the disclosed system, it is a thermally-broken (i.e., no direct thermal path from exterior of structure to interior) glazing system which allows for the glass to be attached directly to structural elements comprising steel or other materials, thus eliminating the need for an aluminum substructure. The benefits of the disclosed systems over conventional methodology, which uses an aluminum interface system, are reduced weight, cost, and complexity, and design flexibility.

As shown in FIGS. 1*a*-2*c*, a blocking of plastic, wood, rubber, or other material is attached to the building's structural elements. In certain embodiments, threaded steel studs are welded, screwed, or otherwise attached to the structure, and holes in the blocking allow the blocking to be fitted over the studs and secured by a nut and washer. In other embodiments, steel channel is welded to the structure, and then the blocking is fitted inside the channel and secured by screws or other fasteners extending through the channel and into the blocking.

In certain embodiments, the blocking material is covered with a metal flashing, and an adhesive-backed gasket (such as rubber or other material) is placed over the lower edge of the metal flashing, so that it covers the edge of the metal flashing and prevents water from infiltrating under the metal flashing. A glass panel is mounted on the gasket and held in place with a continuous glazing bar (or "cap") that is fastened by screws driven through the glazing bar into the blocking material. Many different configurations of this assembly are possible from single glazing bars to multiple bars attached to the blocking material, and from vertical to horizontal to angular attachments of the bars. The blocking is made of a material that facilitates the fastening of the glazing caps, and is preferably not thermally conductive.

Figure 1A:
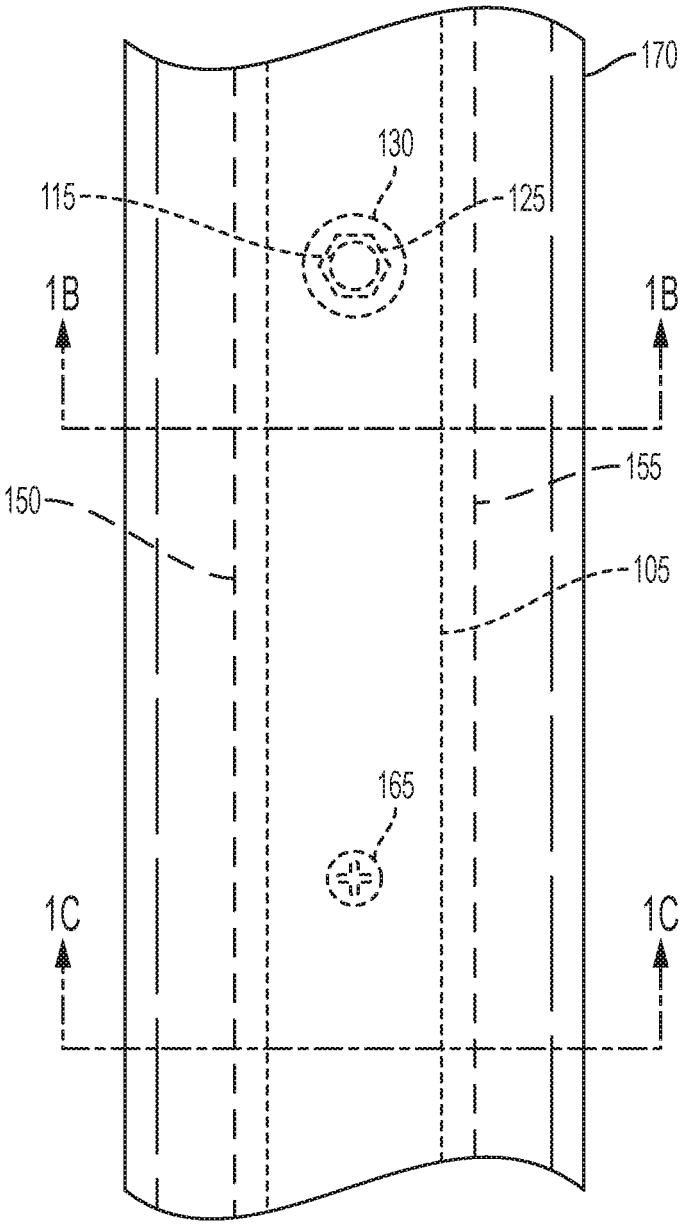
FIG. 1*a* is a top view of a system according to an embodiment of the present disclosure.
Figure 1B:
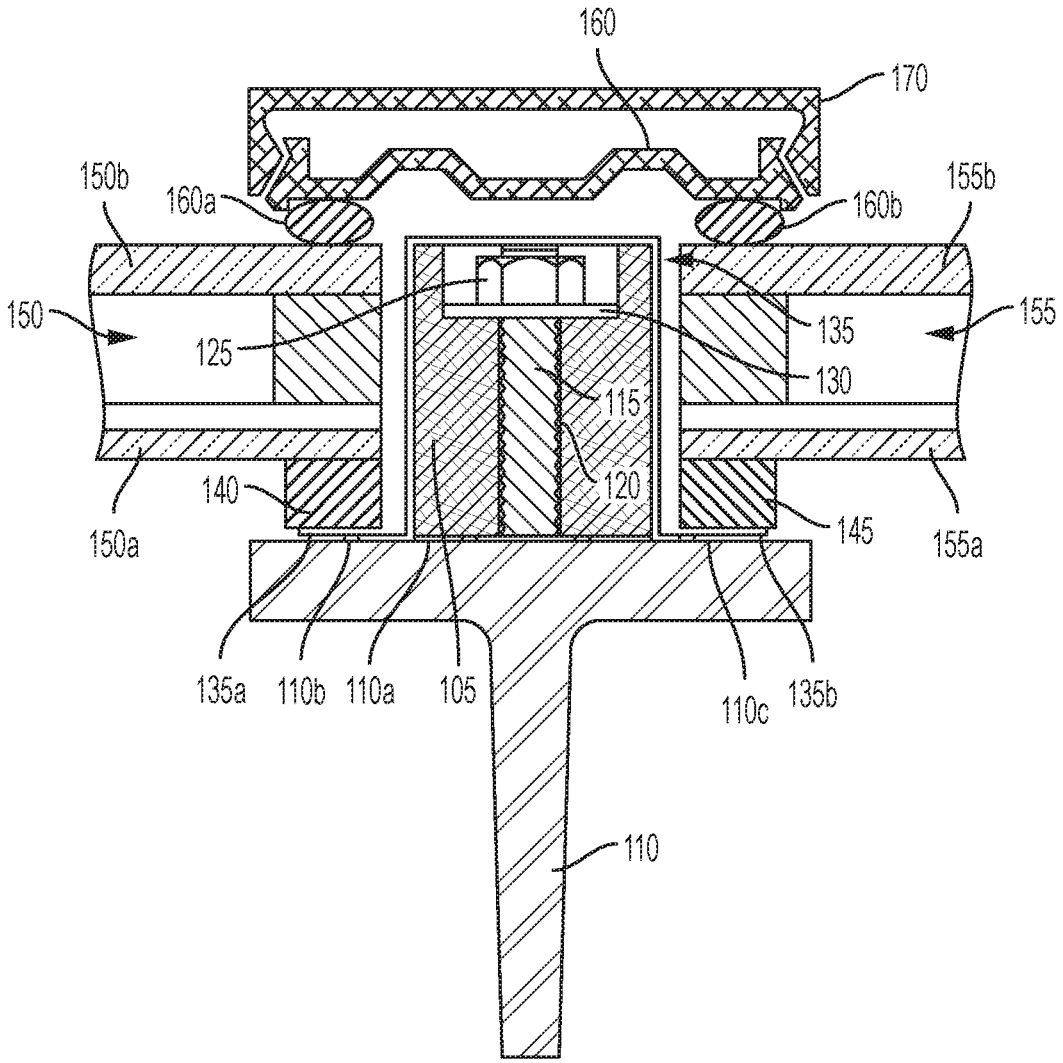
FIGS. 1*b* and 1*c* are cross-sectional views of the system of FIG. 1*a*.
Figure 1C:
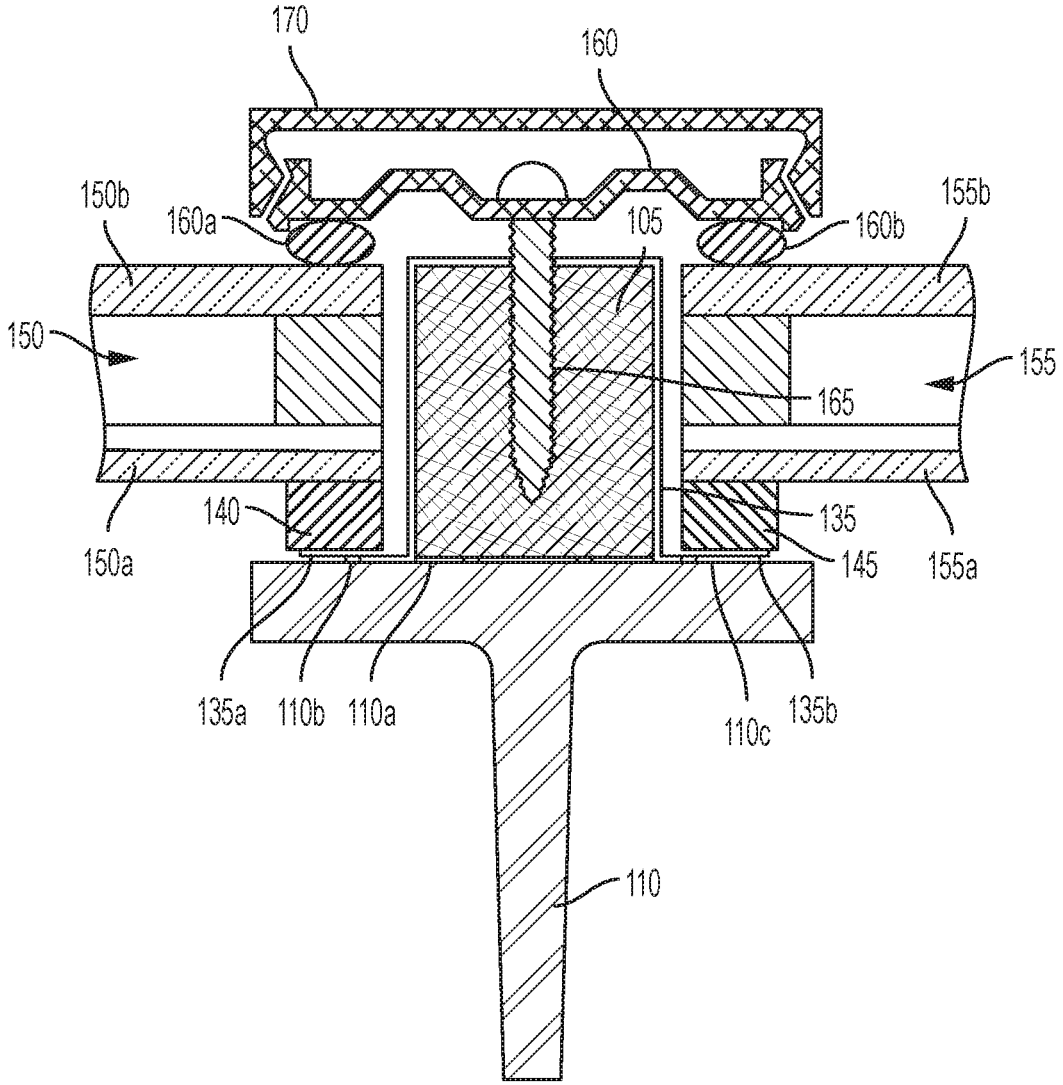

FIGS. 1*a*-*c* illustrate an exemplary embodiment of the disclosed system and method. As best seen in FIGS. 1*b*-*c*, a blocking 105, either continuous or discontinuous, extends along a length of a structural element 110 and is attached to a first portion 110*a* of a surface of the structural element 110. As discussed herein above, the blocking 105 is made of a material that facilitates the fastening of glazing cap(s), and is preferably not thermally conductive. In certain embodiments, the blocking 105 is made of a plastic, wood, or rubber material. The structural element 110 is a metal such as steel, and has threaded studs 115 attached to the first portion 110*a* of its surface. The blocking 105 comprises through holes 120 corresponding to the studs 115 and engagable with the studs 115. The blocking 105 is securable to the structural element 110 by fasteners (such as nuts 125 and washers 130) threaded onto the studs 115.

A flashing 135 covers the blocking 105 and has a first flange 135*a* extending outward from a lower edge of the blocking 105 proximal the first portion 110*a* of the surface of the structural element 110, to contact a second portion 110*b* of the surface of the structural element 110 not in contact with the blocking 105. The flashing 135 also has a second flange 135*b* on an opposing side of the blocking 105 from the first flange 135*a*, the second flange 135*b* extending outward from a lower edge of the opposing side of the blocking 105 proximal the first portion 110*a* of the surface of the structural element, to contact a third portion 110*c* of the surface of the structural element 110 not in contact with the blocking 105. The flashing 135 can be made of a well-known material; e.g., a thin metal such as steel or aluminum.

A first elastic flange gasket 140 is provided for covering an outer edge of the first flange 135*a* for preventing water from infiltrating; for example, between the first flange 135*a* and the first flange gasket 140. A second elastic flange gasket 145 is provided for covering an outer edge of the second flange 135*b*; for example, for preventing water from infiltrating between the second flange 135*b* and the second flange gasket 145. Each of gaskets 140, 145 are, for example, adhesive-backed rubber or other material.

A first glass panel 150 has inner and outer main surfaces 150*a*, 150*b*, respectively, and the first flange gasket 140 is for contacting the inner main surface 155*a* of the first glass panel 150 and supporting the first glass panel 150. Likewise, a second glass panel 155 has inner and outer main surfaces 155*a*, 155*b*, respectively, and the second flange gasket 145 is for contacting the inner main surface 155*a* of the second glass panel 155 and supporting the second glass panel 155. The glass panels 150, 155 are conventional insulated glass panels.

A glazing cap 160 extends continuously along the length of the blocking 105, the glazing cap 160 having a first elastic cap gasket 160*a* for contacting the outer main surface 150*b* of the first glass panel 150, and a second elastic cap gasket 160*b* for contacting the outer main surface 155*b* of the second glass panel 155. The glazing cap 160 extends over and attaches to the blocking 105; for example, by fasteners 165 such as stainless steel screws extending through the cap 160 and the flashing 135 and into the blocking 105. The glazing cap 160 has a removable cover 170 which is snapped on after the glazing cap 160 is attached to the blocking 105. The glazing cap 160 retains the first glass panel 150 between the first flange gasket 140 and the first cap gasket 160*a* such that water is prevented from infiltrating between the first glass panel 150 and the first flange gasket 140, and between the first glass panel 150 and the first cap gasket 160*a*. The glazing cap 160 also retains the second glass panel 155 between the second flange gasket 145 and the second cap gasket 160*b*, such that water is prevented from infiltrating between the second glass panel 155 and the second flange gasket 145, and between the second glass panel 155 and the second cap gasket 160*b*.

Figure 2A:
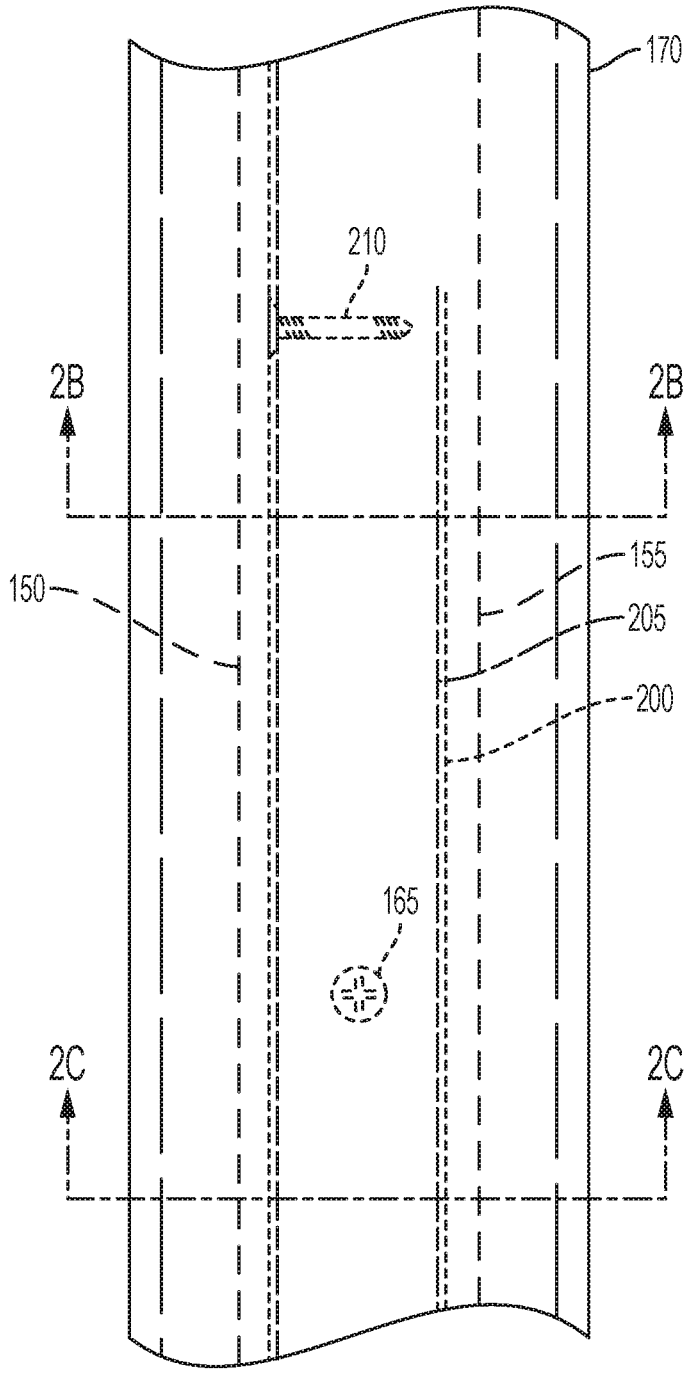
FIG. 2*a* is a top view of a system according to a further embodiment of the present disclosure.
Figure 2B:
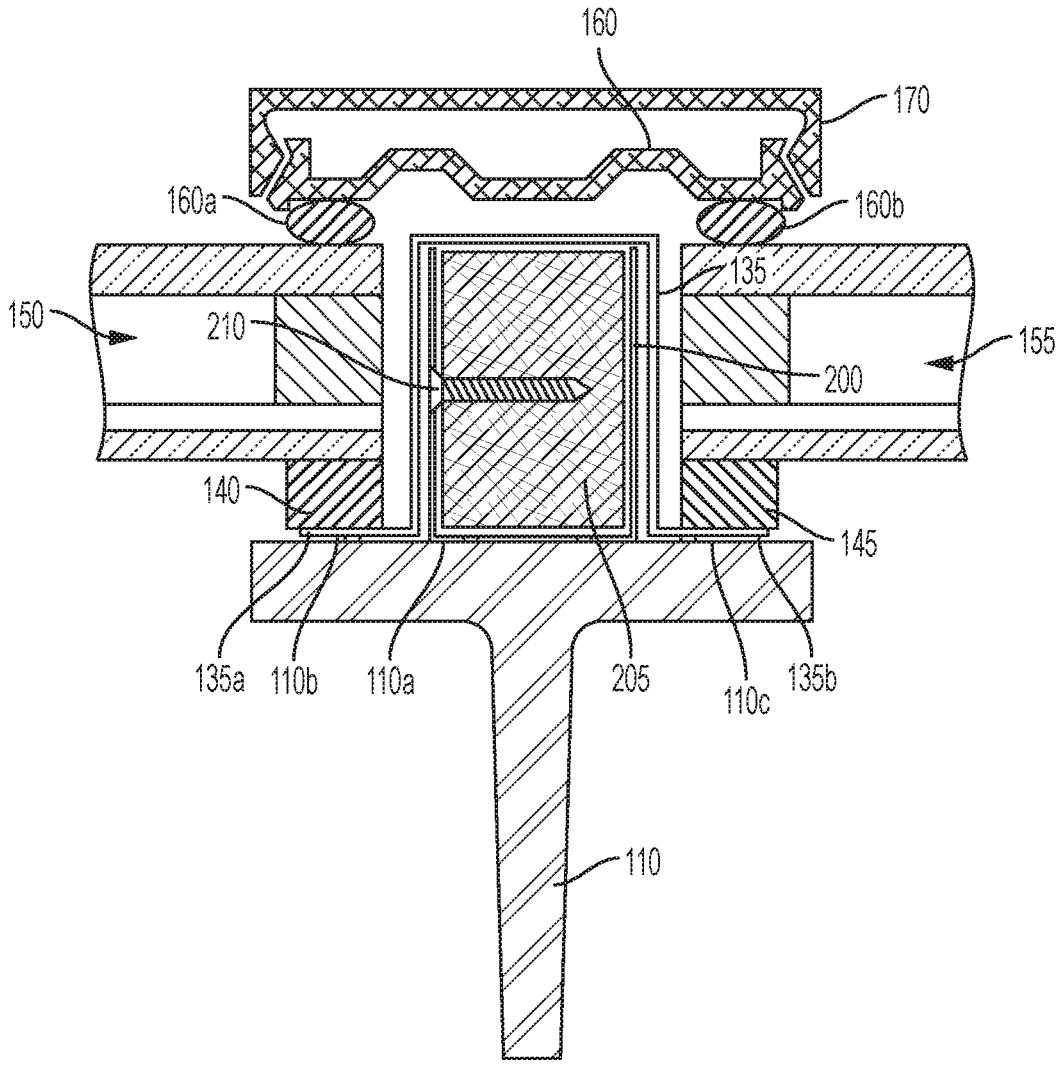
FIGS. 2*b* and 2*c* are cross-sectional views of the system of FIG. 2*a*.
Figure 2C:
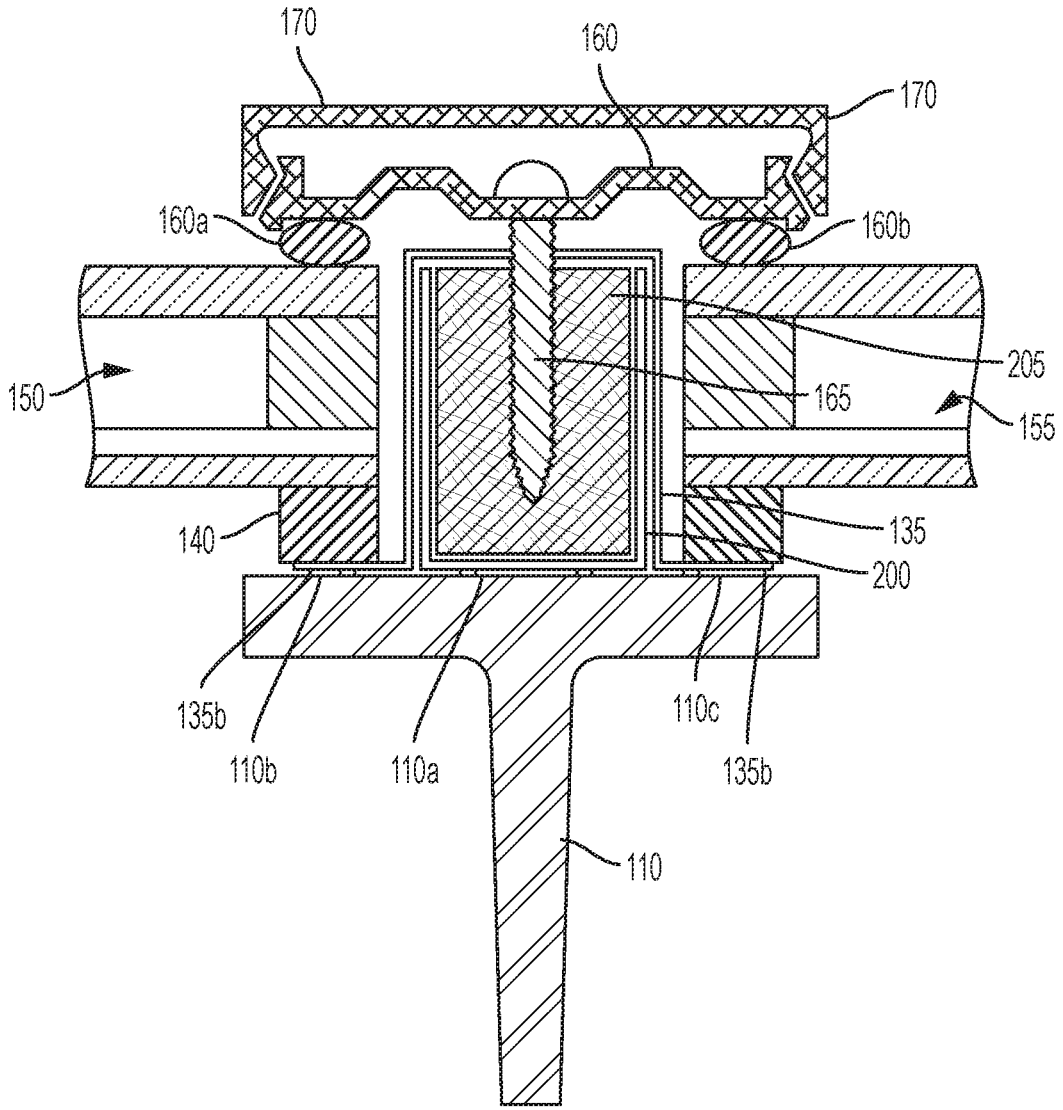

In an alternative embodiment shown in FIGS. 2*a*-*c*, instead of studs, washers, and nuts attaching the blocking to the structural element, a steel channel is welded to the structural element, and the blocking is fitted inside the channel and secured by screws or other fasteners. As best seen in FIG. 2*b*, a U-shaped steel channel 200 is attached, as by welding, to the first portion 110*a* of the surface of the structural element 110. A blocking 205 fits inside the channel 200, and is securable to the channel 200 by fasteners 210, such as stainless steel screws, extending through the channel 200 and into the blocking 205. The flashing 135 is fitted over the steel channel 200. The rest of the system is identical to that of FIGS. 1*a-c*.

Figure 3:
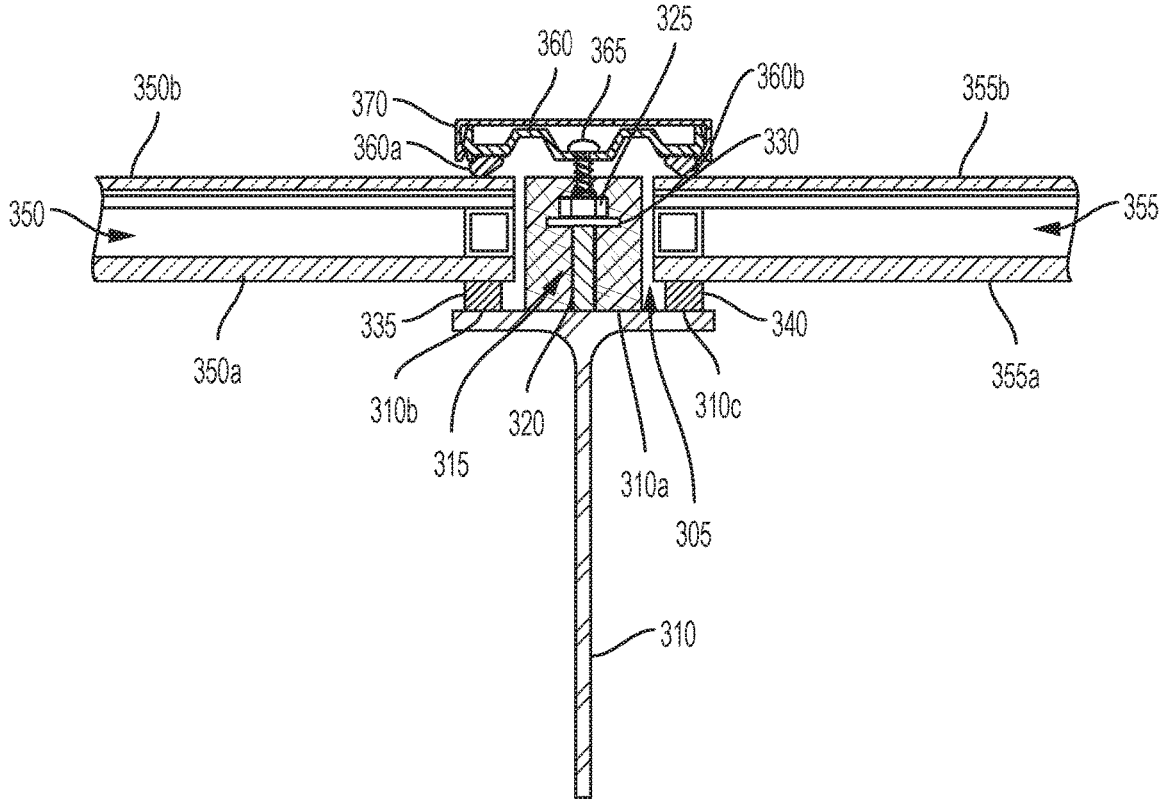
FIG. 3 is a cross-sectional view of a system according to another embodiment of the present disclosure.

In a further embodiment of the disclosed system shown in FIG. 3, the flashing is omitted and gaskets sit directly on the surface of the structural element, rather than on flanges of the flashing. A blocking 305, either continuous or discontinuous, extends along a length of a structural element 310 and is attached to a first portion 310*a* of a surface of the structural element 310. As discussed herein above, the blocking 305 is made of a material that facilitates the fastening of glazing cap(s), and is preferably not thermally conductive. In certain embodiments, the blocking 305 is made of a plastic, wood, or rubber material. The structural element 310 is a metal such as steel, and has threaded studs 315 attached to the first portion 310*a* of its surface. The blocking 305 comprises through holes 320 corresponding to the studs 315 and engagable with the studs 315. The blocking 305 is securable to the structural element 310 by fasteners (such as nuts 325 and washers 330) threaded onto the studs 315.

A continuous elastic first lower gasket 335 extends along the length of the structural element 310 on a second portion 310*b* of the surface of the structural element 310 not in contact with the blocking 305 and adjacent to the first portion 310*a* of the surface of the structural element 310, for preventing water from infiltrating; e.g., between the first lower gasket 335 and the second portion 310*b* of the surface of the structural element 310. Likewise, a second elastic lower gasket 340 extends along the length of the structural element 310 on a third portion 310*c* of the surface of the structural element not in contact with the blocking and adjacent to the first portion of the surface of the structural element 310, for preventing water from infiltrating; e.g., between the second lower gasket 340 and the third portion 310*c* of the surface of the structural element 310. Each of gaskets 335, 340 are, for example, adhesive-backed rubber or other material.

A first glass panel 350 has inner and outer main surfaces 350*a*, 350*b*, respectively, and the first lower gasket 335 is for contacting the inner main surface 350*a* of the first glass panel 350, and supporting the first glass panel 350. Likewise, a second glass panel 355 has inner and outer main surfaces 355*a*, 355*b*, respectively, and the second lower gasket 340 is for contacting the inner main surface 355*a* of the second glass panel 355, and supporting second glass panel 355. The glass panels 350, 355 are conventional insulated glass panels.

A glazing cap 360 extends continuously along the length of the blocking 305, the glazing cap 360 having a first elastic cap gasket 360*a* for contacting the outer main surface 350*b* of the first glass panel 350, and a second elastic cap gasket 360*b* for contacting the outer main surface 355*b* of the second glass panel 355. The glazing cap 360 extends over and attaches to the blocking 305; for example, by fasteners 365 such as stainless steel screws extending through the cap 360 and into the blocking 305. The glazing cap 360 has a removable cover 370 which is snapped on after the glazing cap 360 is attached to the blocking 305. The glazing cap 360 retains the first glass panel 350 between the first lower gasket 335 and the first cap gasket 360*a* such that water is prevented from infiltrating between the first glass panel 350 and the first lower gasket 335, and between the first glass panel 350 and the first cap gasket 360*a*. The glazing cap 360 also retains the second glass panel 355 between the second lower gasket 340 and the second cap gasket 360*b*, such that water is prevented from infiltrating between the second glass panel 355 and the second lower gasket 340, and between the second glass panel 355 and the second cap gasket 360*b*.

Figure 4:
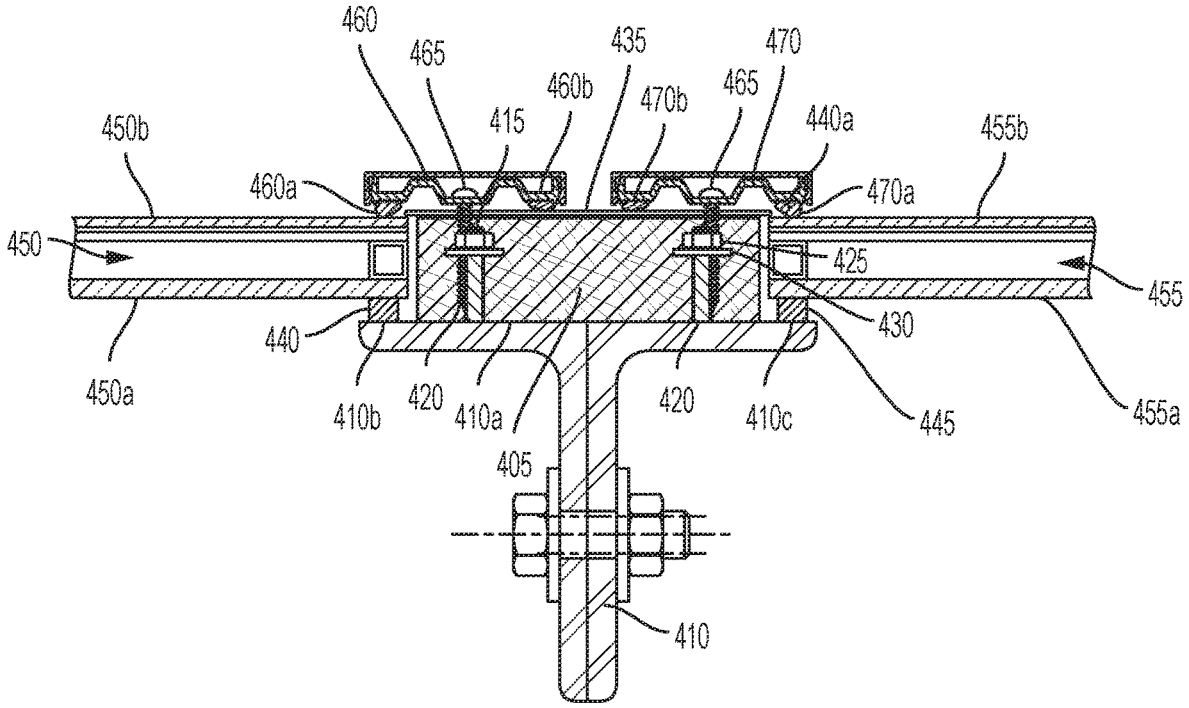
FIG. 4 is a cross-sectional view of a system according to a further embodiment of the present disclosure.

In a further embodiment of the disclosed system shown in FIG. 4, two glass panels are attached to a relatively wide substrate, and each glass panel is retained by a separate glazing cap. A continuous or discontinuous blocking 405 extends along a length of a structural element 410 and is attached to a first portion 410*a* of a surface of the structural element 410. As discussed herein above, the blocking 105 is made of a material that facilitates the fastening of the glazing caps, and is preferably not thermally conductive. In certain embodiments, the blocking 405 is made of a plastic, wood, or rubber material. The structural element 410 is a metal such as steel, and has threaded studs 415 attached to the first portion 410*a* of its surface. The blocking 405 comprises through holes 420 corresponding to the studs 415 and engagable with the studs 415. The blocking 405 is securable to the structural element 410 by fasteners (such as nuts 425 and washers 430) threaded onto the studs 415.

The blocking 405 has an upper surface, and a flashing 435, such as a metal flashing, covers the upper surface of the blocking 405.

A continuous elastic first lower gasket 440 extends along the length of the structural element 410 on a second portion 410*b* of the surface of the structural element 410 not in contact with the blocking 405 and adjacent to the first portion 410*a* of the surface of the structural element 410, for preventing water from infiltrating; e.g., between the first lower gasket 440 and the second portion 410*b* of the surface of the structural element 410. Likewise, a second elastic lower gasket 445 extends along the length of the structural element 410 on a third portion 410*c* of the surface of the structural element not in contact with the blocking and adjacent to the first portion of the surface of the structural element 410, for preventing water from infiltrating; e.g., between the second lower gasket 445 and the third portion 410*c* of the surface of the structural element 410. Each of gaskets 440, 445 are, for example, adhesive-backed rubber or other material.

A first glass panel 450 has inner and outer main surfaces 450*a*, 450*b*, respectively, and the first lower gasket 440 is for contacting the inner main surface 450*a* of the first glass panel 450 and supporting the first glass panel 450. Likewise, a second glass panel 455 has inner and outer main surfaces 455*a*, 455*b*, respectively, and the second lower gasket 445 is for contacting the inner main surface 455*a* of the second glass panel 455 and supporting the second glass panel 455. The glass panels 450, 455 are conventional insulated glass panels.

A first glazing cap 460 extends continuously along a length of the blocking, 405 and has a first elastic cap gasket 460*a* for contacting the outer main surface of the first glass panel 450 and a second elastic cap gasket 460*b* for contacting the flashing 435, the first glazing cap 460 extending over and attaching to the blocking 405 for retaining the first glass panel 450 between the first lower gasket 440 and the first cap gasket 460*a* such that water is prevented from infiltrating between the first glass panel 450 and the first lower gasket 440 and between the first glass panel 450 and the first cap gasket 460*a*, and such that water is prevented from infiltrating between the flashing 435 and the second cap gasket 460*a*. The first glazing cap 460 is attachable to the blocking by fasteners 465 extending through the first glazing cap 460 and the flashing 435 and into the blocking 405.

A second glazing cap 470 extends continuously along the length of the blocking 405, and has a third elastic cap gasket 470*a* for contacting the outer main surface of the second glass panel 455 and a fourth elastic cap gasket 470*b* for contacting the flashing 435, the second glazing cap 470 extending over and attaching to the blocking 405 for retaining the second glass panel 455 between the second lower gasket 445 and the third cap gasket 470*a* such that water is prevented from infiltrating between the second glass panel 455 and the second lower gasket 445 and between the second glass panel 455 and the third cap gasket 470*a*, and such that water is prevented from infiltrating between the flashing 435 and the fourth cap gasket 470*b*. The second glazing cap 470 is attachable to the blocking by fasteners 465 extending through the second glazing cap 470 and the flashing 435 and into the blocking 405.

Figure 5:
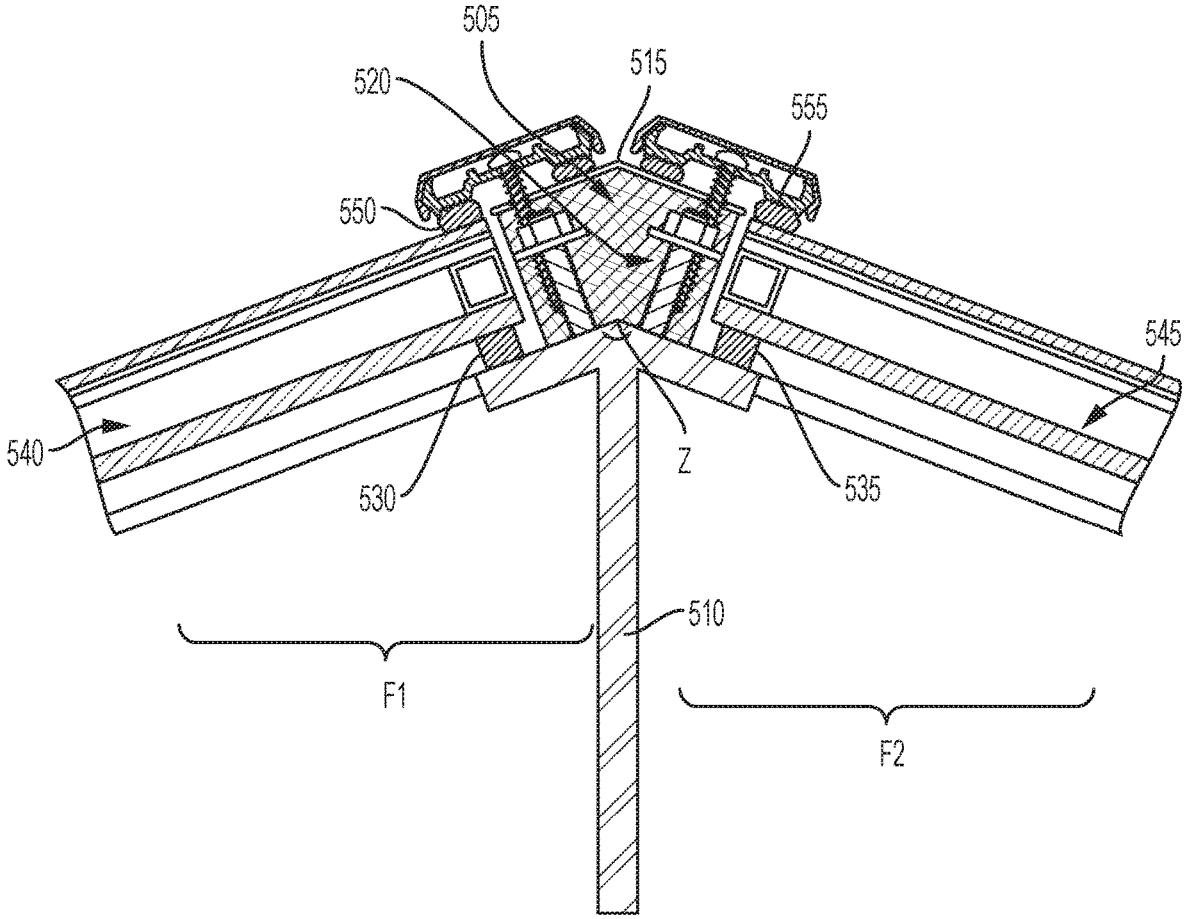
FIG. 5 is a cross-sectional view of a system according to a still further embodiment of the present disclosure.

In a variation of the embodiment of FIG. 4, the structural element, blocking, and flashing have an angular shape to create a corner or roof peak where two glass panels are attached. Referring now to FIG. 5, in this embodiment a blocking 505, a surface of a structural element 510, and a flashing 515 each have a corresponding angular shape comprising first and second facets F1 and F2 with an included angle Z there between. The rest of the system is structurally and functionally identical in relevant part to that of FIG. 4, including threaded studs 520 attached to the surface of the structural element 510 to retain the blocking 505. A first lower gasket 530, first glass panel 540, and first glazing cap 550 are associated with the first facet F1 along with the blocking 505, the flashing 515, and the surface of the structural element 510. A second lower gasket 535, a second glass panel 545, and a second glazing cap 555 are associated with the second facet F2 along with the blocking 505, the flashing 515, and the surface of the structural element 510.

Figure 6:
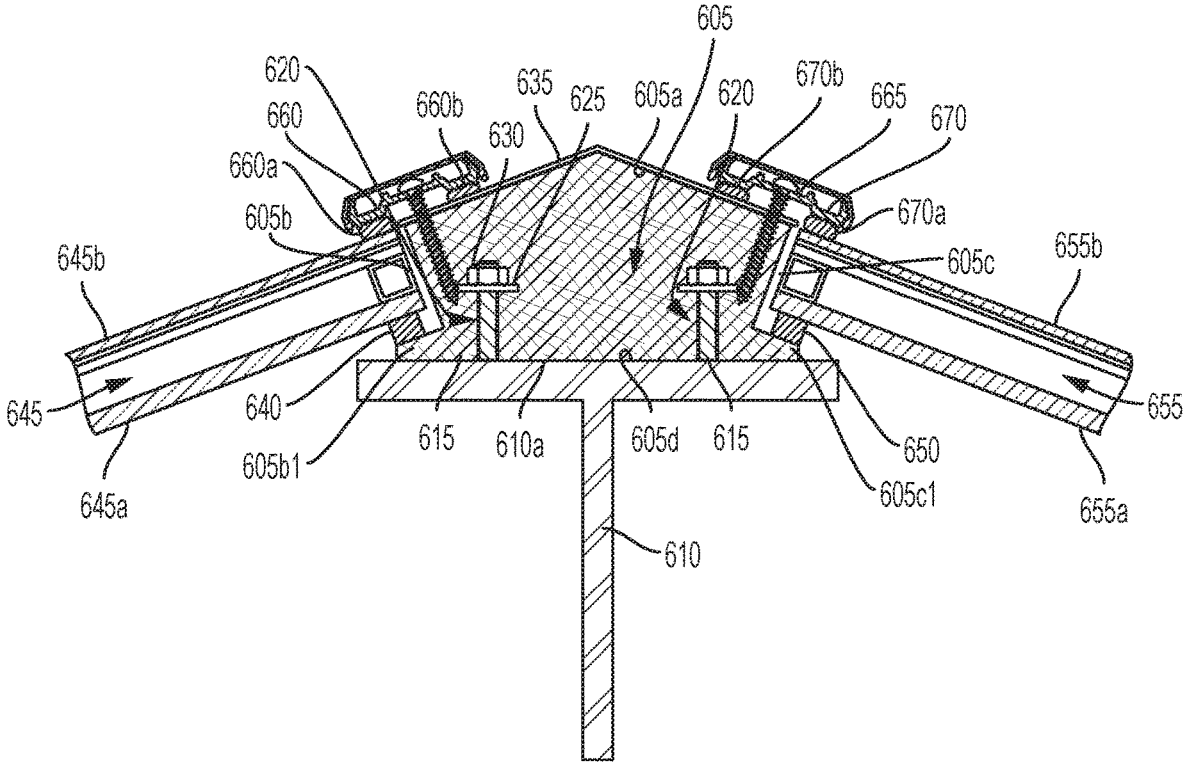
FIG. 6 is a cross-sectional view of a system according to another embodiment of the present disclosure.

In a still further embodiment of the disclosed system and methodology, the surface of the structural element is flat, the blocking and flashing have an angular shape, and the blocking has a step for mounting the lower gaskets. As shown in FIG. 6, a continuous or discontinuous blocking 605 extends along a length of a structural element 610 and is attached to a surface 610*a* of the structural element 610. As in previously-described embodiments, threaded studs 615 are welded or otherwise attached to the surface 610*a* of the structural element, and corresponding holes 620 in the blocking fit over the studs 615 and the blocking is secured by washers 625 and nuts 630.

The blocking has an upper surface 605*a*, a lower surface 605*d* for contacting the structural element surface 610*a*, and a pair of opposing first and second side surfaces 605*b*, 605*c* between the upper and lower surfaces. Each of the side surfaces has a step portion 605*b*1, 605*c*1 extending outward proximal to where the respective side surface meets the blocking lower surface 605*d*. A flashing 635, such as a metal flashing, covers the upper surface 605*a* of the blocking. In the embodiment shown in FIG. 6, the side surfaces 605*b*, 605*c* of the blocking form an angle other than 90 degrees with the surface 610*a* of the structural element. The upper surface 605*a* of the blocking and the flashing 635 are correspondingly angularly shaped. Those of skill in the art will understand that the angles enable the system of this embodiment to form a glass panel roof having a peak.

A continuous elastic first lower gasket 640 extends along a length of the step portion 605*b*1 of the first side surface 605*b* of the blocking, for preventing water from infiltrating; e.g., between the first lower gasket 640 and the step portion 605*b*1. A first glass panel 645 has inner and outer main surfaces 645*a*, 645*b*, and the first lower gasket 640 is for contacting the inner main surface 645*a* of the first glass panel 645, and supporting the first glass panel 645. Likewise, a second elastic lower gasket 650 extends along the length of the step portion 605*c*1 of the second side surface 605*c* of the blocking for preventing water from infiltrating; e.g., between the second lower gasket 650 and the step portion 605*c*1. A second glass panel 655 has inner and outer main surfaces 655*a*, 655*b*, and the second lower gasket 650 is for contacting the inner main surface 655*a* of the second glass panel 655, and supporting the second glass panel 655.

A first glazing cap 660 extends continuously along a length of the blocking 605, having a first elastic cap gasket 660*a* for contacting the outer main surface 645*b* of the first glass panel 645 and a second elastic cap gasket 660*b* for contacting the flashing 635. The first glazing cap 660 extends over and attaches to the blocking 605 (as by screws 665) for retaining the first glass panel 645 between the first lower gasket 640 and the first cap gasket 660*a* such that water is prevented from infiltrating between the first glass panel 645 and the first lower gasket 640 and between the first glass panel 645 and the first cap gasket 660*a*, and such that water is prevented from infiltrating between the flashing 635 and the second cap gasket 660*b*.

Similarly, a second glazing cap 670 extends continuously along the length of the blocking 605, having a third elastic cap gasket 670*a* for contacting the outer main surface 655*b* of the second glass panel 655 and a fourth elastic cap gasket 670*b* for contacting the flashing 635. The second glazing cap 670 extends over and attaches to the blocking 605 (as by screws 665) for retaining the second glass panel 655 between the second lower gasket 650 and the third cap gasket 670*a* such that water is prevented from infiltrating between the second glass panel 655 and the second lower gasket 650 and between the second glass panel 655 and the third cap gasket 670*a*, and such that water is prevented from infiltrating between the flashing 635 and the fourth cap gasket 670*d*.

It is, therefore, apparent that there is provided in accordance with the present disclosure, a method and system for attaching glass panels to a substructure. While this disclosure has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this disclosure.

What is claimed is:

1. A system comprising:

a blocking extending along a length of a structural element and attached to a first portion of a surface of the structural element;

a flashing covering a top surface of the blocking and extending from the top surface along side surfaces of the blocking to have a first flange extending outward from a lower edge of the blocking proximal the first portion of the surface of the structural element, to contact a second portion of the surface of the structural element not in contact with the blocking;

a first elastic flange gasket for covering an outer edge of the first flange;

a first glass panel having inner and outer main surfaces, wherein the first flange gasket is for contacting the inner main surface of the first glass panel;

a glazing cap, extending along a length of the blocking, having a first elastic cap gasket for contacting the outer main surface of the first glass panel, the glazing cap extending over and attaching to the blocking for retaining the first glass panel between the first flange gasket and the first elastic cap gasket; and a U-shaped channel attached to and in contact with the first portion of the surface of the structural element;

wherein the blocking is fitted inside the channel, and is secured to the channel by fasteners extending through the channel and into the blocking.

2. The system of claim 1, wherein the blocking comprises one of a plastic, wood, or rubber material.

3. The system of claim 1, wherein the channel and the structural element comprise steel, and the channel is welded to the first portion of the surface of the structural element.

4. The system of claim 1, wherein the glazing cap is attachable to the blocking by fasteners extending through the cap and the flashing and into the blocking.

5. The system of claim 1, wherein the first glass panel comprises an insulated glass panel.

6. The system of claim 1, wherein the flashing comprises a second flange on an opposing side of the blocking from the first flange, the second flange extending outward from a lower edge of the opposing side of the blocking proximal the first portion of the surface of the structural element, to contact a third portion of the surface of the structural element not in contact with the blocking, the system further comprising:

a second elastic flange gasket for covering an outer edge of the second flange; and a second glass panel having inner and outer main surfaces, wherein the second flange gasket is for contacting the inner main surface of the second glass panel;

wherein the glazing cap has a second elastic cap gasket for contacting the outer main surface of the second glass panel, for retaining the second glass panel between the second flange gasket and the second cap gasket.

7. A system comprising:

a blocking extending along a length of a structural element, the blocking being in contact with and attached to a first portion of a surface of the structural element;

a flashing covering an upper surface of the blocking;

an elastic first lower gasket extending along the length of the structural element on a second portion of the surface of the structural element not in contact with the blocking and adjacent to the first portion of the surface of the structural element;

a first glass panel having inner and outer main surfaces, wherein the first lower gasket is for contacting the inner main surface of the first glass panel;

a first glazing cap, extending along a length of the blocking, having a first elastic cap gasket for contacting the outer main surface of the first glass panel and a second elastic cap gasket for contacting the flashing, the first glazing cap extending over and attaching to the blocking for retaining the first glass panel between the first lower gasket and the first cap gasket;

a second elastic lower gasket extending along the length of the structural element on a third portion of the surface of the structural element not in contact with the blocking and adjacent to the first portion of the surface of the structural element;

a second glass panel having inner and outer main surfaces, wherein the second lower gasket is for contacting the inner main surface of the second glass panel; and a second glazing cap, extending along the length of the blocking, having a third elastic cap gasket for contacting the outer main surface of the second glass panel and a fourth elastic cap gasket for contacting the flashing, the second glazing cap extending over and attaching to the blocking for retaining the second glass panel between the second lower gasket and the third cap gasket; and studs attached to the first portion of the surface of the structural element;

wherein the blocking comprises through holes corresponding to the studs and engagable with the studs.

8. The system of claim 7, wherein the first glazing cap is attachable to the blocking by fasteners extending through the first glazing cap and the flashing and into the blocking.

9. The system of claim 7, wherein the second glazing cap is attachable to the blocking by fasteners extending through the second glazing cap and the flashing and into the blocking.

10. The system of claim 7, wherein the blocking, the flashing, and the surface of the structural element each have a corresponding angular shape comprising first and second facets with an included angle therebetween;

wherein the first lower gasket, the first glass panel, and the first glazing cap are associated with an assembly of the first facet along with the blocking, the flashing, and the surface of the structural element; and wherein the second lower gasket, the second glass panel, and the second glazing cap are associated with an assembly of the second facet along with the blocking, the flashing, and the surface of the structural element.

11. The system of claim 7, wherein the blocking comprises one of a plastic, wood, or rubber material.

12. The system of claim 11, wherein the side surfaces of the blocking form an angle other than 90 degrees with the surface of the structural element, and the upper surface of the blocking and the flashing are correspondingly angularly shaped.

13. The system of claim 7 wherein the blocking is securable to the structural element by fasteners threaded onto the studs.

14. A system comprising:

a blocking extending along a length of a structural element, the blocking being in contact with and attached to a surface of a structural element, the blocking having an upper surface, a lower surface for contacting the structural element surface, and a pair of opposing first and second side surfaces between the upper and lower surfaces, each of the side surfaces having a step portion extending outward proximal to where the side surface meets the blocking lower surface;

a flashing covering the upper surface of the blocking;

an elastic first lower gasket extending along a length of the step portion of the first side surface of the blocking;

a first glass panel having inner and outer main surfaces, wherein the first lower gasket is for contacting the inner main surface of the first glass panel;

a first glazing cap, extending along a length of the blocking, having a first elastic cap gasket for contacting the outer main surface of the first glass panel and a second elastic cap gasket for contacting the flashing, the first glazing cap extending over and attaching to the blocking for retaining the first glass panel between the first lower gasket and the first cap gasket;

a second elastic lower gasket extending along the length of the step portion of the second side surface of the blocking;

a second glass panel having inner and outer main surfaces, wherein the second lower gasket is for contacting the inner main surface of the second glass panel; and a second glazing cap, extending along the length of the blocking, having a third elastic cap gasket for contacting the outer main surface of the second glass panel and a fourth elastic cap gasket for contacting the flashing, the second glazing cap extending over and attaching to the blocking for retaining the second glass panel between the second lower gasket and the third cap gasket.

15. The system of claim 14, wherein the blocking comprises one of a plastic, wood, or rubber material.

16. The system of claim 14, comprising threaded studs attached to the surface of the structural element;

wherein the blocking comprises through holes corresponding to the studs and engagable with the studs, and the blocking is securable to the structural element by fasteners threaded onto the studs.

* * * * *